US007635048B2

(12) United States Patent
Copley et al.

(10) Patent No.: US 7,635,048 B2
(45) Date of Patent: Dec. 22, 2009

(54) SOUND SUPPRESSION DEVICE FOR INTERNAL COMBUSTION ENGINE SYSTEM

(75) Inventors: David C. Copley, Peoria, IL (US); James Callas, Peoria, IL (US); Kevin L. Martin, Washburn, IL (US)

(73) Assignee: Caterpillar Inc., Peoria, IL (US)

( * ) Notice: Subject to any disclaimer, the term of this patent is extended or adjusted under 35 U.S.C. 154(b) by 422 days.

(21) Appl. No.: 11/583,521

(22) Filed: Oct. 19, 2006

(65) Prior Publication Data

US 2008/0093159 A1 Apr. 24, 2008

(51) Int. Cl.
*F02B 77/13* (2006.01)

(52) U.S. Cl. ..... 181/204; 181/200; 181/205

(58) Field of Classification Search ..... 181/200, 181/204, 205

See application file for complete search history.

(56) References Cited

U.S. PATENT DOCUMENTS 3,762,489 A 10/1973 Proksch et al.
3,897,850 A 8/1975 Thompson et al.
4,048,366 A * 9/1977 Kingsbury ..... 428/215
4,110,876 A * 9/1978 Weiss et al. ..... 28/271
4,149,512 A * 4/1979 Hatz ..... 123/198 E
4,347,043 A * 8/1982 Morris ..... 417/53
4,483,412 A 11/1984 Couturier
4,993,381 A 2/1991 Absenger
5,151,018 A * 9/1992 Clendenin et al. ..... 417/312
5,272,285 A * 12/1993 Miller ..... 181/202
5,456,291 A * 10/1995 Kunzmann ..... 138/121
5,467,747 A * 11/1995 Brandt et al. ..... 123/198 E
5,625,172 A 4/1997 Blichmann et al.
5,681,072 A * 10/1997 Stricker ..... 296/39.3
5,832,726 A * 11/1998 Rees et al. ..... 60/322
5,996,730 A * 12/1999 Pirchl ..... 181/211
6,062,033 A * 5/2000 Choi ..... 62/296
6,237,717 B1 * 5/2001 Osanai et al. ..... 181/294
6,273,213 B1 8/2001 Callas et al.
6,302,466 B1 10/2001 Zwick
6,554,101 B2 4/2003 Watanabe et al.

(Continued)

FOREIGN PATENT DOCUMENTS

DE 41 37 706 A 5/1993

(Continued)

*Primary Examiner*—Jeffrey Donels
*Assistant Examiner*—Jeremy Luks
(74) *Attorney, Agent, or Firm*—Liell & McNeil

(57) ABSTRACT

A machine is provided having an engine system wherein at least one engine system component with an acoustic reflective surface is surrounded by a jacket configured to absorb sound from at least one sound producing device of the engine system. The jacket includes a sound absorbing material such as fibrous thermal insulation and an acoustic permeable covering between the acoustic reflective surface and the engine compartment of the machine. The acoustic permeable covering of the jacket may comprise a micro-perforated skin, whereby acoustic energy from the at least one sound producing device of the engine system can enter a volume defined by the jacket wherein it is absorbed by the sound absorbing material. A method of operating an engine system includes dissipating engine sound within a jacket surrounding an engine system component, the jacket including an acoustic permeable covering and a sound absorbing material positioned within the covering. An exhaust aftertreatment element may by thermally insulated with the jacket.

8 Claims, 3 Drawing Sheets

U.S. PATENT DOCUMENTS

| | | | | |
|---|---|---|---|---|
| 6,595,013 | B1 | 7/2003 | Simeone | |
| 6,601,673 | B2 | 8/2003 | Murakami et al. | |
| 6,604,603 | B1 * | 8/2003 | Wirth | 181/200 |
| 6,688,424 | B1 | 2/2004 | Nakada et al. | |
| 6,722,466 | B1 * | 4/2004 | Tong et al. | 181/200 |
| 6,823,571 | B1 * | 11/2004 | Ragland et al. | 29/17.4 |
| 6,827,180 | B2 | 12/2004 | Wilson | |
| 2004/0146395 | A1 | 7/2004 | Uselton | |
| 2005/0005773 | A1 * | 1/2005 | Shutty et al. | 96/417 |
| 2005/0028516 | A1 * | 2/2005 | Kiesewetter et al. | 60/276 |
| 2005/0056481 | A1 * | 3/2005 | Mafi et al. | 181/202 |
| 2005/0274569 | A1 * | 12/2005 | Seel | 181/202 |
| 2006/0103171 | A1 | 5/2006 | Blomeling | |

FOREIGN PATENT DOCUMENTS

| | | | |
|---|---|---|---|
| DE | 44 12 427 | | 10/1994 |
| DE | 199 39 482 | A | 3/2001 |
| DE | 100 01 932 | A | 8/2001 |
| EP | 1 251 062 | A | 10/2002 |
| JP | 04126928 | A | 4/1992 |

* cited by examiner

SOUND SUPPRESSION DEVICE FOR INTERNAL COMBUSTION ENGINE SYSTEM

TECHNICAL FIELD

The present disclosure relates generally to sound suppression devices and strategies for internal combustion engine systems, and relates more particularly to an engine system having a component positionable within an engine compartment which is surrounded by a noise absorbing jacket.

BACKGROUND

Operation of internal combustion engine systems inherently produces audible sound. In many environments, engine noise is considered objectionable, particularly at certain frequencies and intensities. The multitude of moving parts and combustion explosions attendant to engine operation tend to generate noise in a frequency range and at intensities which can be annoying to operators and bystanders in the general vicinity of an engine. In recent years, certain jurisdictions have enacted regulations specifically directed to reducing noise associated with engine systems and other machines.

Engineers have long used a variety of means to block, absorb and/or redirect noise generated by operation of internal combustion engine systems. In the context of mobile machines such as trucks and construction machines, it is well known to place sound absorbing panels in various positions about an engine compartment such that noise generated during operation of the engine system is prevented from travelling outwardly to the extent practicable. A variety of materials and assemblies specifically directed to blocking engine sound from escaping to ambient have been proposed.

United States Patent Application Publication No. 2006/0103171 to Blomeling et al. is directed to one type of sound suppressing panel system for positioning about engine system components. In particular, Blomeling et al. ("Blomeling") propose a sound insulation strategy using an underbody covering with a sound-absorbing part covered with a micro-perforated, heat shielding layer. In one version of Blomeling's design, the micro-perforated layer is exposed toward an underbody of a motor vehicle in the vicinity of parts of an exhaust train. Thus, in Blomeling sound would apparently travel from the inside of a motor vehicle through a micro-perforated layer and then be absorbed within the sound-absorbing part rather than escaping to the ambient environment. The disclosure, however, does not provide a suitable strategy for addressing noise issues where the vehicle structure is not amenable to the extensive use of sound suppression panels, or the use of such panels is insufficient to meet noise regulations.

There are obvious limitations to the extent to which an engine system, vehicle, etc. may be successfully isolated from ambient with sound suppression panels. On the one hand, if weight, size and hardware mounting issues did not exist, then any vehicle or engine system could be shielded from emitting noxious noise to the environment simply by adding additional sound suppression panels. Certain machine and engine system configurations, however, can limit the extent to which sound suppression panels may be positioned within and/or about an engine compartment. Expected future changes in engine emissions requirements have required certain new components to be added to some types of engine systems, or existing components such as particulate filters to be increased in size. Such components may be positioned inside an engine compartment and occupy space that was formerly available for positioning sound suppression panels. In addition, some newer engine operating strategies have come into common practice which increase the cooling demands on the engine cooling system, increasing the need to provide venting for the engine system and still further limiting the use of sound suppression panels about the engine compartment. While certain engine systems may be vented through a hood of the machine, this approach works poorly in the dusty and debris-laden environments often encountered by construction machines. Engineers have thus turned to placing vents in side panels of a machine body to permit some heat energy to escape. An undesired consequence of this approach, however, is the transmission of additional sound outwardly from the engine system. There is thus a multiplicity of concerns driving the search for improved means of suppressing engine system noise.

The present disclosure is directed to one or more of the problems or shortcomings set forth above.

SUMMARY OF THE INVENTION

In one aspect, the present disclosure provides an engine system that includes a housing defining an engine compartment and having at least one sound producing device therein. At least one engine system component is provided, including an acoustic reflective surface, and a jacket surrounding the at least one engine system component. The jacket is configured to absorb sound from the at least one sound producing device, and includes a sound absorbing material and an acoustic permeable covering between the acoustic reflective surface and the engine compartment.

In another aspect, the present disclosure provides a machine that includes a chassis having a housing mounted thereon which defines an engine compartment, and an engine system disposed within the engine compartment. The machine further includes at least one engine system component having an acoustic reflective surface, and a jacket surrounding the at least one engine system component. The jacket is configured to absorb sound generated within the engine compartment, and includes a sound absorbing material and an acoustic permeable covering between said acoustic reflective surface and said engine compartment.

In still another aspect, the present disclosure provides a method of operating an engine system. The method includes generating sound by operating the engine system, and dissipating generated sound within a jacket surrounding at least one engine system component, including passing acoustic energy through an acoustic permeable covering of the jacket, reflecting acoustic energy off an acoustic reflective surface of the at least one engine system component and absorbing acoustic energy with a sound absorbing material of the jacket.

DETAILED DESCRIPTION

Figure 1:
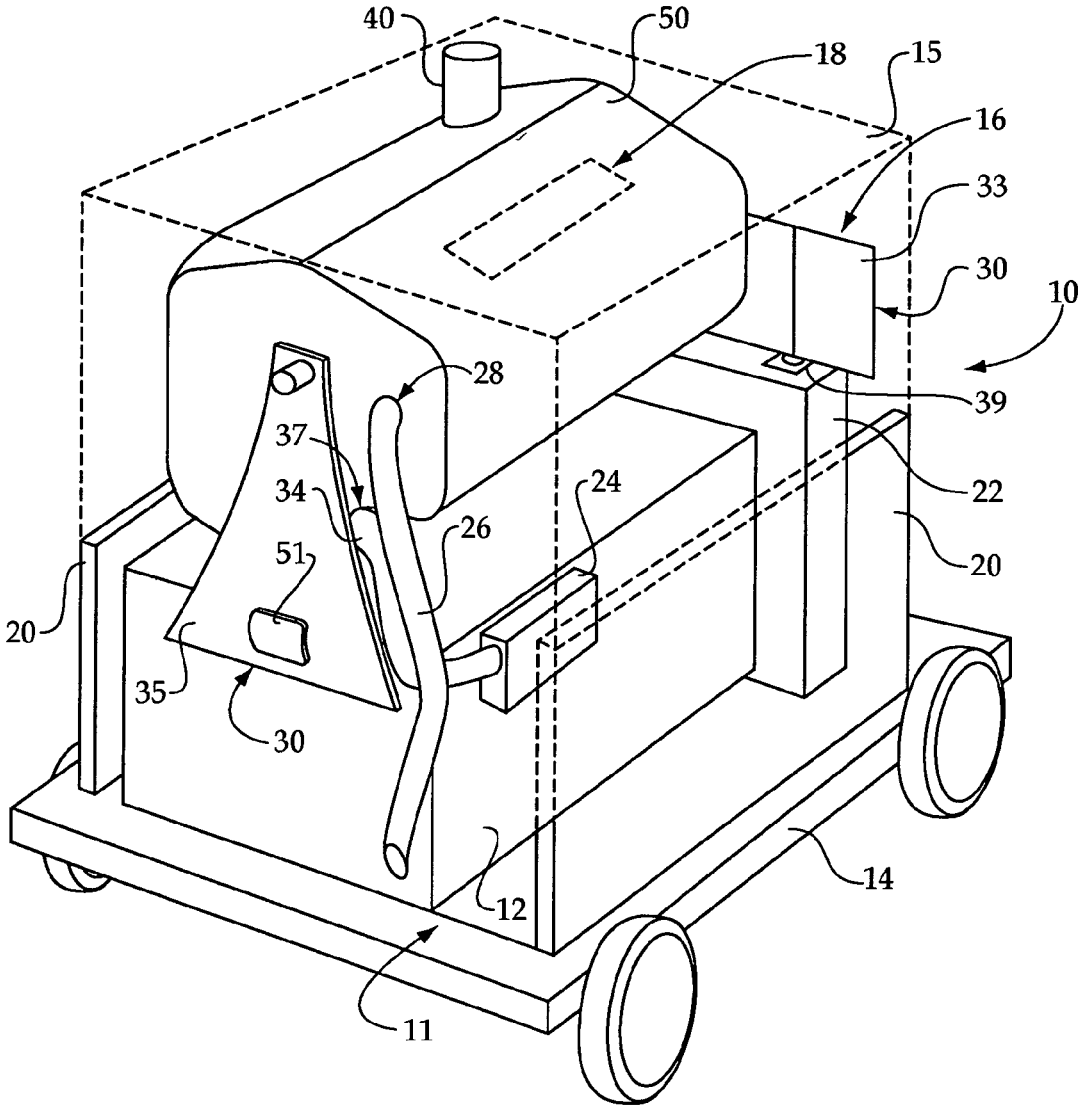
FIG. 1 is a diagrammatic view of a machine in accordance with one embodiment of the present disclosure.

Referring to FIG. 1, there is shown a machine 10 mounted on a chassis 14, according to the present disclosure. Chassis 14 may comprise a wheeled chassis as are in common use for a variety of machines such as on-highway trucks, off-highway trucks and construction machines. Rather than wheels, however, tracks, etc. might be used. Further, rather than a mobile machine, the present disclosure contemplates stationary machines such as gensets, compressors, pumps, and virtually any conceivable machine employing an engine system. Thus, machine 10 may include an engine system 11 positioned within an engine compartment 16 defined by a housing 15. Engine system 11 may include an engine 12, for example a compression ignition internal combustion engine, and at least one sound producing device. It should be appreciated that many if not most components of engine system 11 may generate sound during operation. Thus, the sound producing device contemplated herein may include, for example, engine 12 itself, a turbocharger 24, various fans, rotors, shafts, cams, compressors, etc., as well as groups of such components. Thus, references herein to a noise or sound producing device should be understood as referring generically to any engine system component or group of components having moving parts or otherwise capable of generating audible undesired sound, in other words, noise. Engine system 11 is equipped to suppress sound attendant to engine operation in a manner distinct and superior to previous sound suppression strategies, as described herein.

Machine 10, via engine system 11, may be equipped to suppress sound generated by the at least one sound producing device via a jacket 50 surrounding at least one engine system component 18 which is configured to absorb a portion of sound generated within engine compartment 16. As used herein, the term "surrounding" should not be construed to mean that jacket 50 must completely encapsulate the engine system component, and jacket 50 may include open ends or comprise some other openings, as described herein. In one practical implementation strategy, jacket 50 may comprise a specialized enclosure substantially encapsulating one or more components 18 of engine system 11, such that sound generated with engine compartment 16 is dissipated within jacket 50 rather than escaping to ambient. The strategy set forth in the present disclosure is contemplated to reduce the need for suppressing engine system sound via sound suppression panels or other means. Where sound suppression panels are used component 18, surrounded with jacket 50, will provide a supplementary way of reducing sound, resulting in relatively quieter operation than was attainable with previous designs.

The at least one engine system component 18 having jacket 50 surrounding the same may be mounted within engine compartment 16, for example, on a 3-point mounting frame 30. Mounting frame 30 may include a first frame component 33 configured to support one end of engine system component 18 on first and second mounts 39, only one of which is shown, positioned generally toward one end of engine compartment 16 and disposed generally proximate corners of first frame component 33. Frame 30 may further include a second frame component 35 that supports another end of engine system component 18, and may be mounted via a mounting member 51 to engine 12 itself, or some other suitable structure. Other mounting configurations having more than three or less than three mounting points are contemplated herein, however, 3-point mounting is considered to be well suited to the environment within engine compartment 16 where vibrations and shocks are relatively frequent.

It is contemplated that jacket 50 may be positioned to surround any engine system component, and the illustrated embodiment, further described herein, should not be construed in a limiting sense. For instance, the various fluid reservoirs, compressors, pumps, turbochargers, etc. may be equipped with a sound suppressing jacket, all in a similar manner. Jacket 50 might even be positioned about a structural component within engine compartment 16. Engine system 11 may further include a radiator system 22, and one or more sound suppressing panels 20, which are separate from engine system component 18, positioned about engine compartment 16.

Figure 2:
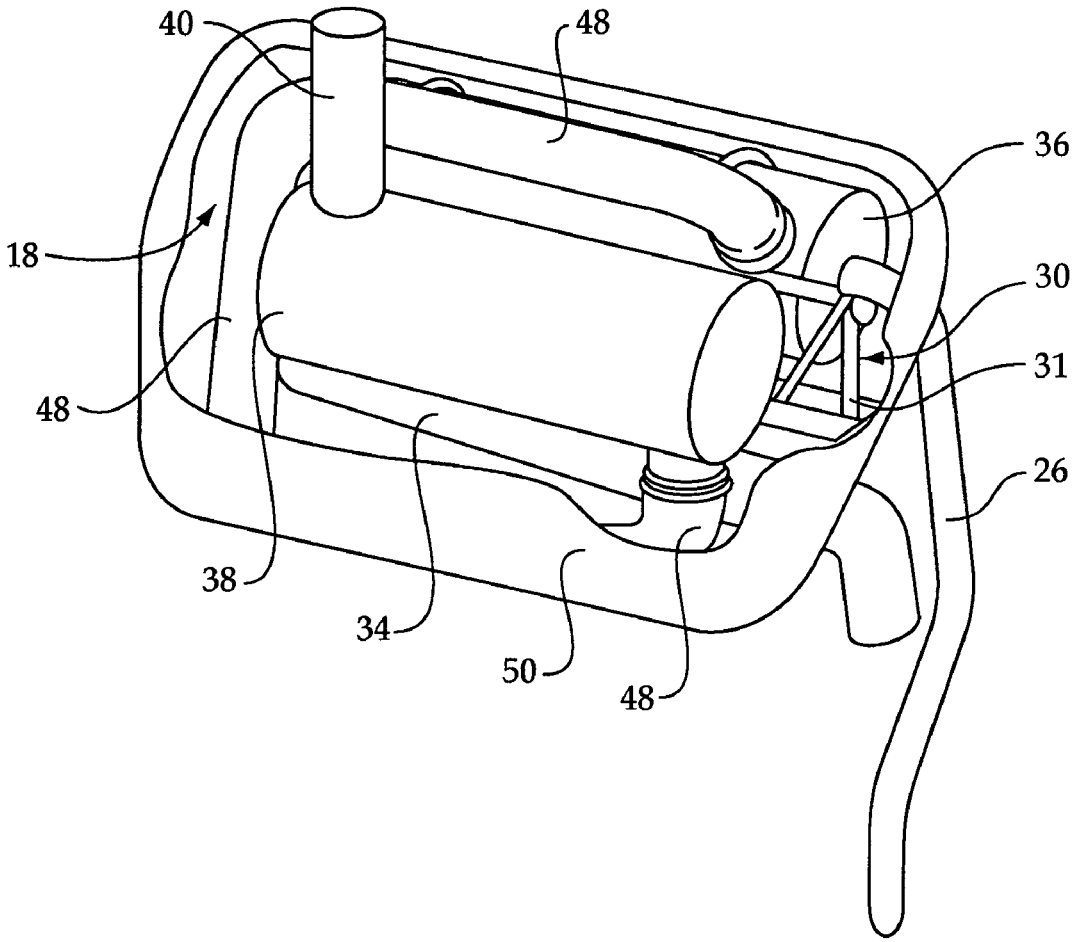
FIG. 2 is a diagrammatic view of an engine system component having a noise absorbing jacket, partially in cut away, suitable for use in an engine system according to the present disclosure.

Referring also to FIG. 2, there is shown a partial cut-away view that illustrates certain of the components 18 surrounded by jacket 50, including at least one exhaust process element 36 and 38. The exhaust process elements 36 and 38 may include any component(s) adapted to support or effectuate a process relating to handling or routing, physically or chemically treating or recovering energy from engine exhaust, etc. In one embodiment, the at least one exhaust process element may comprise an exhaust aftertreatment device including at least one of a particulate filter 36 and a NOx reduction device 38. An exhaust passage 48 may connect particulate filter 36 with NOx reduction device 38. Jacket 50 may also include one or more outlets to permit exhaust to pass out of one or more of filter 36 and NOx reduction device 38. In particular, an exhaust stack 40 may extend out of jacket 50 from NOx reduction device 38, and another exhaust passage 26 may extend via an outlet 28 out of jacket 50 for exhaust gas recirculation, for example. Yet another exhaust passage 34 may consist of a primary exhaust passage from engine 12 to the components housed within jacket 50, and may enter jacket 50 via an inlet 37.

Figure 3:
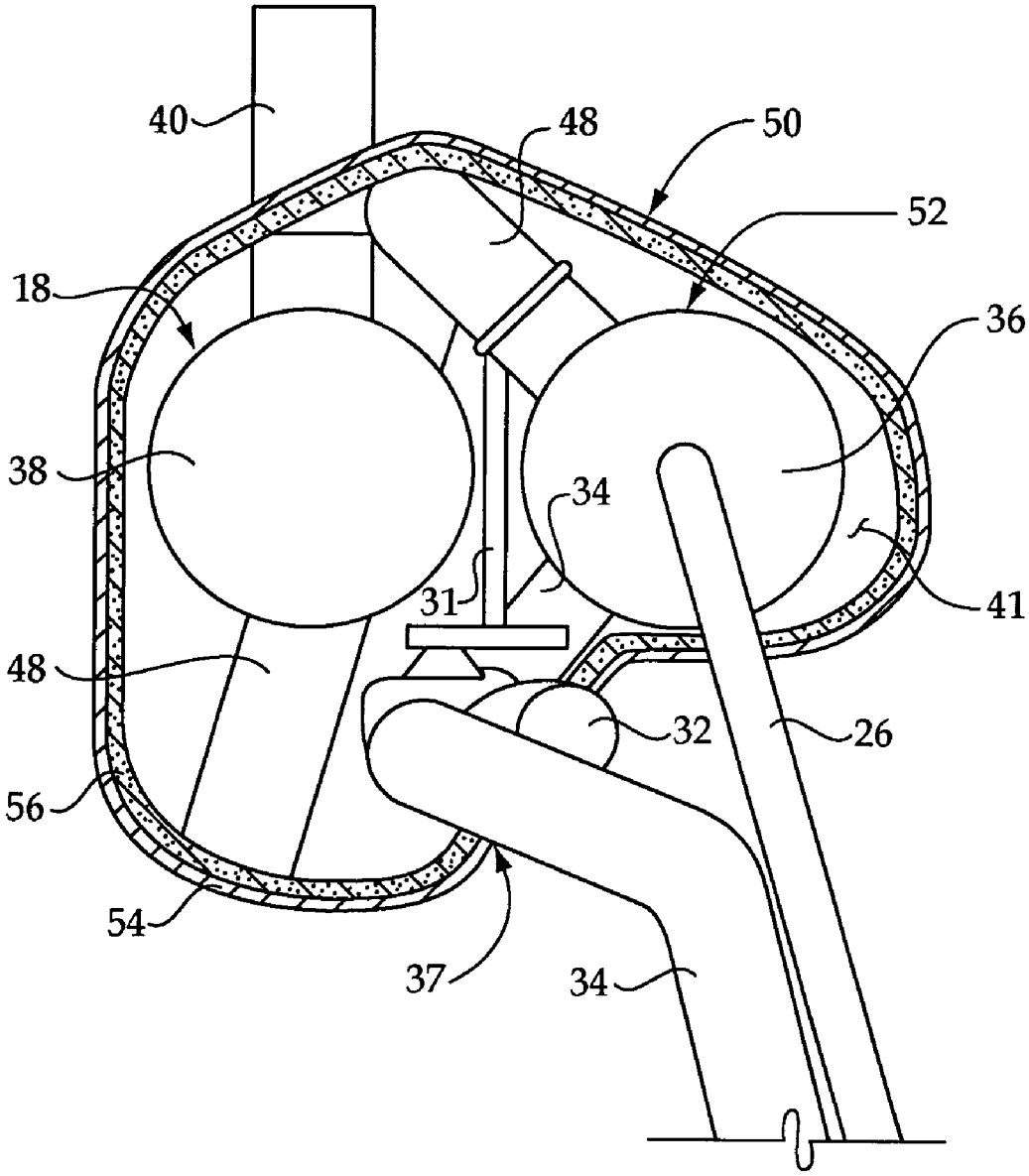
FIG. 3 is a partially sectioned end view of an engine system component and jacket similar to that shown in FIG. 2.

Referring in addition to FIG. 3, an auxiliary regeneration device 32 may also be positioned within, or fluid connected with, an appropriate exhaust passage such as passage 34 and accessible from outside jacket 50. Auxiliary regeneration device 32 may be used to regenerate particulate filter 36 in a manner known in the art. While it is contemplated that the at least one engine system component 18 may be any of a wide variety of components, the illustrated embodiment of particulate filter 36 and NOx reduction device 38 are considered to be particularly appropriate for positioning within jacket 50, as such components are generally used, or in the future are expected to be used, with relatively heavy duty compression ignition diesel engines, of which engine 12 may be one. Particulate filter 36 and NOx reduction device 38 may also occupy significant volume within engine compartment 16 which may be advantageously used in suppressing engine sound, as described herein, and might otherwise simply take up space. Moreover, it is generally desirable to place thermal insulation about exhaust process elements 36 and 38, and its use may be leveraged to serve the additional function of absorbing sound, as further described herein. In other embodiments, a layer such as sheet metal which is substantially acoustically impermeable could be positioned about filter 35 and NOx reduction device 38, and located within jacket 50.

Also shown in FIGS. 2 and 3 is an I-beam 31, part of frame 30, which may extend between ends of jacket 50, either extending through to an outside of jacket 50 or being housed entirely therein, which is configured to provide support to components 36 and 38. Other mounting configurations are contemplated, however, the use of I-beam 31 and optionally additional components such as retention straps extending around all of the components internal to jacket 50 may provide one practical implementation strategy.

As alluded to above, jacket 50 is specially constructed such that acoustic energy may be dissipated therein rather than escaping to ambient. To this end, jacket 50 may include an external, acoustically permeable layer such as a metallic micro-perforated skin 54, configured to permit acoustic energy to pass from engine compartment 16 into an internal volume defined by jacket 50. One commercial source for suitable micro-perforated skin is Sontech Noise Control, of Odecon, Sweden AB. Other suitable acoustically permeable materials are known to those in the acoustic arts. In any event, it is desirable to utilize a material for skin 54 that is permeable to acoustic energy relative to an acoustic reflective surface 52 of the at least one engine component 18. In other words, skin 54 should be relatively more permeable to acoustic energy than an acoustic reflective surface 52, for example an outer surface, of one of components 18. A sound absorbing material 56, which may comprise a thermally insulating material such as a fibrous thermal insulation, e.g. mineral wool, fiber glass, etc. may be positioned within skin 54 such that acoustic energy reflecting within the volume of jacket 50 may be absorbed by material 56. Skin 54 will typically be positioned between material 56 and engine compartment 16. Skin 54 may include a first thickness, for example about 0.5 millimeters, whereas material 56 may have a second, greater thickness. Holes in micro-perforated skin 54 may be in the range of about 0.05 millimeters to about 0.5 millimeters.

INDUSTRIAL APPLICABILITY

During operation of engine system 11, sound will typically be generated within engine compartment 16 by a variety of sources, including rotating and colliding components, from combustion explosions, vibrations, etc. A portion of the generated acoustic energy will pass through skin 54, and be reflected off of acoustic reflective surface 52. In general terms, once acoustic energy, or sound waves, reflects from acoustic reflective surface 52, or any other surface within volume 41 of jacket 50, the acoustic energy will have less of a tendency to pass back out through skin 54, as the direction of reflected sound waves will tend to differ from their direction upon initially passing through skin 54. As a result, a significant portion of sound waves within jacket 50 will be absorbed by material 56. In this fashion, the combination of jacket 50 and component(s) 18 will absorb acoustic energy that might otherwise escape from engine compartment 16 to ambient.

The present disclosure provides substantial advantages over conventional noise suppression strategies in engine and machine systems which sought only to prevent acoustic energy from escaping the engine compartment. Rather than attempting to encapsulate an engine compartment with acoustic panels, occupying space and thermally insulating the entire engine system, the present disclosure provides a new means of absorbing a portion of acoustic energy within the engine compartment itself. Implementation of the present disclosure promises to obviate or reduce the need for sound suppression panels in certain engine systems and in certain operating environments. And, where sound suppression panels are used, the sound absorbing jacket and engine system component combinations described herein will work in conjunction with sound suppression panels to reduce undesired sound still further than what is attainable with conventional systems. Further still, in many diesel engine systems, such as engine system 11, particulate filters and NOx reduction devices are becoming standard components. It is typically necessary to thermally insulate these exhaust system components anyway, to protect other engine components and prevent heating the engine intake air, and thus the addition of a micro-perforated metallic skin permits the thermally insulating material to serve as a sound absorbing material without adding significant weight and expense to the overall system. Skin 54 still further provides mechanical protection for material 56, and components 18 nested therein.

The present disclosure is for illustrative purposes only, and should not be construed to narrow the breadth of the present disclosure in any way. Thus, those skilled in the art will appreciate that various modifications might be made to the presently disclosed embodiments without departing from the intended spirit and scope of the present disclosure. For instance, while the present description focuses on surrounding related exhaust process elements 36 and 38 with jacket 50 it should be appreciated that engine system components of unrelated subsystems might be positioned together. The design for jacket 50 is also not limited to that disclosed herein, and may be tailored to accommodate the components which it is intended to surround. In one design, jacket 50 might comprise an approximate clamshell configuration having first and second portions that can be closed about one or more components to permit the components and jacket 50 to absorb sound within an engine compartment as described herein. Other aspects, features and advantages would be apparent upon an examination of the attached drawings and appended claims.

What is claimed is:

1. An engine system comprising:

at least one sound producing device disposed in an engine compartment defined by a housing:

at least one engine system component disposed in the engine compartment and including an acoustic reflective surface, the at least one engine system component comprising an exhaust process element, said exhaust process element comprising an exhaust aftertreatment device, said exhaust aftertreatment device comprising at least one of a particulate filter and a NOx reduction device;

a support beam coupled with the at least one of a particulate filter and a NOx reduction device;

a jacket surrounding said at least one engine system component and configured to absorb sound from said at least one sound producing device, said jacket including a sound absorbing material and an acoustic permeable covering between said acoustic reflective surface and said engine compartment. the acoustic permeable covering comprising a micro-perforated skin; and said sound absorbing material comprising a thermally insulating material disposed between said acoustic reflective surface and said micro-perforated skin.

2. A machine comprising:

a housing defining an engine compartment;

an engine system disposed within said engine compartment;

said engine system comprising at least one engine system component having an acoustic reflective surface, said at least one engine system component comprising an exhaust process element;

said engine system further comprising a jacket including a sound absorbing material comprising a thermally insulating material, and an acoustic permeable covering between said acoustic reflective surface and said engine compartment, said acoustic permeable covering comprising a micro-perforated skin surrounding said thermally insulating material;

said jacket surrounding said at least one engine system component and configured to absorb sound generated within said engine compartment and defining an inlet and an outlet configured to permit exhaust flow to and from said exhaust process element; and a support beam extending within said jacket and configured to mount said exhaust process element within said engine compartment.

3. The machine of claim 2 wherein the micro-perforated skin comprises a first thickness and said sound absorbing material comprises a second thickness greater than said first thickness.

4. The machine of claim 3 wherein said exhaust process element comprises an exhaust aftertreatment device having a first process element and a second process element, said sound absorbing material comprising a fibrous thermally insulating material surrounding said first and second process elements.

5. A method of operating an engine system comprising:

providing an engine system comprising at least one sound producing device disposed in an engine compartment defined by a housing, at least one engine system component disposed in the engine compartment and including an acoustic reflective surface, the at least one engine system component comprising an exhaust process element, said exhaust process element comprising an exhaust aftertreatment device, said exhaust aftertreatment device comprising at least one of a particulate filter and a NOx reduction device, said engine system further comprising a support beam coupled with the at least one of a particulate filter and a NOx reduction device, said engine system further comprising a jacket surrounding said at least one engine system component and configured to absorb sound from said at least one sound producing device, said jacket including a sound absorbing material and an acoustic permeable covering between said acoustic reflective surface and said engine compartment, the acoustic permeable covering comprising a micro-perforated skin, said sound absorbing material comprising a thermally insulating material disposed between said acoustic reflective surface and said micro-perforated skin;

generating sound by operating the engine system; and dissipating generated sound within the jacket of the engine system, including passing acoustic energy through the acoustic permeable covering of the jacket, reflecting acoustic energy off the acoustic reflective surface of the at least one engine system component and absorbing acoustic energy with the sound absorbing material of the jacket.

6. The method of claim 5 further comprising a step of dissipating generated sound via acoustic panels positioned about the engine system.

7. The method of claim 6 wherein passing acoustic energy through an acoustic permeable outer covering of the jacket comprises passing acoustic energy through a micro-perforated skin surrounding the sound absorbing material.

8. The method of claim 7 wherein the at least one engine system component comprises a heat radiating component, the method further comprising a step of thermally insulating the heat radiating component via the sound absorbing material and micro-perforated skin of the jacket.

* * * * *